US005348301A

United States Patent [19]

Ma

[11] Patent Number: 5,348,301

[45] Date of Patent: Sep. 20, 1994

[54] HEAD FOR USE WITH A GOLF PUTTER

[76] Inventor: JONG-NAM MA, 3-505, Seonkyung Apt., #592, Seongpo-Dong, Ansan-Si, Kyungki-Do, Rep. of Korea

[21] Appl. No.: 74,468

[22] Filed: Jun. 10, 1993

[51] Int. Cl.[5] ..... A63B 53/04

[52] U.S. Cl. ..... 273/167 B; 273/167 F; 273/169; 273/167 J

[58] Field of Search ..... 273/167 R, 77 R, 169, 273/171, 172, 174, 175, 167 A, 167 B, 167 C, 167 D, 167 E, 167 F, 167 G, 167 H, 167 J, 193 R, 194 R, 164.1, 187.4, 186.2; D21/214–220

[56] References Cited

U.S. PATENT DOCUMENTS

| | | | |
|---|---|---|---|
| 2,445,718 | 7/1948 | Sternberg | 273/167 B |
| 3,085,804 | 4/1963 | Pieper | 273/167 B X |
| 4,312,509 | 1/1982 | Grant | 273/167 A |
| 4,664,385 | 5/1987 | Macera | 273/167 B |
| 4,795,158 | 1/1989 | Kuykendall | 273/167 BX |
| 4,867,457 | 9/1989 | Lowe | 273/167 B |
| 4,881,739 | 11/1989 | Garcia | 273/167 B X |

FOREIGN PATENT DOCUMENTS

| | | | |
|---|---|---|---|
| 592719 | 2/1960 | Canada | 273/167 J |
| 60-2564 | 1/1985 | Japan . | |
| 60-187764 | 12/1985 | Japan . | |
| 652592 | 4/1951 | United Kingdom | 273/167 B |

*Primary Examiner*—Jessica J. Harrison
*Assistant Examiner*—Sebastiano Passaniti
*Attorney, Agent, or Firm*—Birch, Stewart, Kolasch & Birch

[57] ABSTRACT

A head for use with a putter which is used to strike a golf ball gently so that the ball rolls across the putting green into a hole, includes a front hitting portion having a recess at the lower end thereof resulting in the head assuming an inverse U-shape. The hitting portion is inclined rearwardly and downwardly so that the time when the ball contacts with the head is maintained short, thus improving the correctness and applying a strong rotation force in the proceeding direction of the ball.

4 Claims, 2 Drawing Sheets

HEAD FOR USE WITH A GOLF PUTTER

BACKGROUND OF THE INVENTION

Field of the Invention

This invention relates to a head for use with a golf putter which gently strikes a golf ball so that it rolls across the ground toward or into a hole in the putting green.

Description of Related Art

The putting green is an area within a radius of 20 yards of the hole. A putter for use in the putting green has a construction suited to a short hit.

The construction of the putter is different from that of an iron suited to a long hit. In general, the construction of the putter is very simple.

Typical golf heads are disclosed in Japanese Utility Model Publication Nos. So 60-1877664 and 60-2564 which are respectively published on Dec. 12, 1985 and Jan. 10, 1985. In the publications, the club heads fixed to the lower end of the stem have a front hitting portion which is planar or upwardly slanted. The club heads have a disadvantage of incorrectly putting a golf ball into a hole.

FIGS. 1A and 1B show the typical putter. FIGS. 2A through 2D show the hitting of the golf ball with the typical putter having a planar hitting portion. The putter will swing around the shoulder and wrist of a golfer. When the front hitting portion of the head of the putter initially contacts with and then strikes a golf ball 8, the lower end of the head grazes the surface of the putting green and is in a slightly raised position from the surface, with the upper end of the head contacting with the center of the golf ball. In detail, as the swinging movement progresses, the contact point of the golf ball with the hitting portion moves to the lower end of the hitting portion. As the swinging movement further progresses, the golf ball contacts with the tip 10 of the hitting portion, as shown in FIG. 2C.

Therafter, the golf ball and the head of the putter are separated from each other as shown in FIG. 2D.

The problem with the typical putter having the above-described hitting process is that, since the contact time of the golf ball with the hitting portion is long, trembling will occur when swinging club, thereby changing a course of the ball, and lowering the degree of correctness of the ball. The putting green is a smooth area of lawn. When mowing the lawn with a mower, the lawn tends to one side according to the progressing direction of the mower.

Accordingly, when the ball of a weak force of rotation moves toward the hole, the ball tends to curve in the inclined direction of the lawn. To apply a strong force of rotation to the ball, a slanted hitting portion is provided as shown in FIG. 1B.

While the slanted hitting portion applies the force of rotation to the ball, it raises the ball upwards as the swinging movement proceeds since the contact point is provided under the center of the ball. With the slanted hitting portion of the putter head, a course of the ball is unstable. Therefore, the head having a slanted hitting portion is not used with a putter, but used with an iron for long hit.

SUMMARY OF THE INVENTION

To eliminate the above-described disadvantages, this invention provides a golf putter which serves to eliminate the trembling when swinging the club, thereby achieving the degree of correctness by minimizing the contact time of the ball with the hitting portion of the putter head.

This invention further provides a golf putter having a construction which will apply a strong force of rotation in the progressing direction of the ball.

According to the present invention, the front hitting portion of the putter head has a reverse U-shaped recess at the lower end thereof and is inclined rearwardly and downwardly.

DETAILED DESCRIPTION OF THE PREFERRED EMBODIMENTS

Figure 1A:
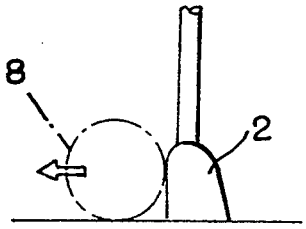
FIG. 1A (PRIOR ART)
FIGS. 1A and 1B are side elevations of the typical golf club.
Figure 1B:
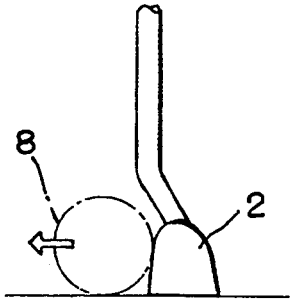
FIG. 1B (PRIOR ART)
Figure 2A:
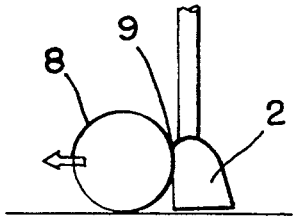
FIG. 2A (PRIOR ART)
FIGS. 2A, 2B, 2C and 2D show the swing with the typical golf club.
Figure 2B:
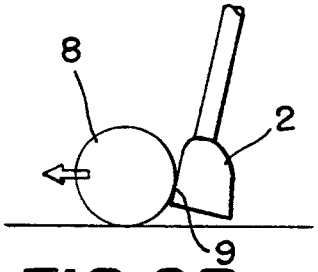
FIG. 2B (PRIOR ART)
Figure 2C:
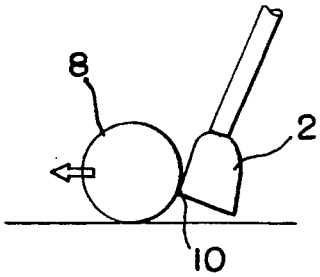
FIG. 2C (PRIOR ART)
Figure 2D:
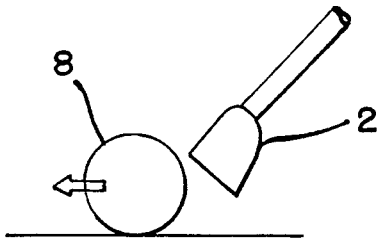
FIG. 2D (PRIOR ART)
Figure 3:
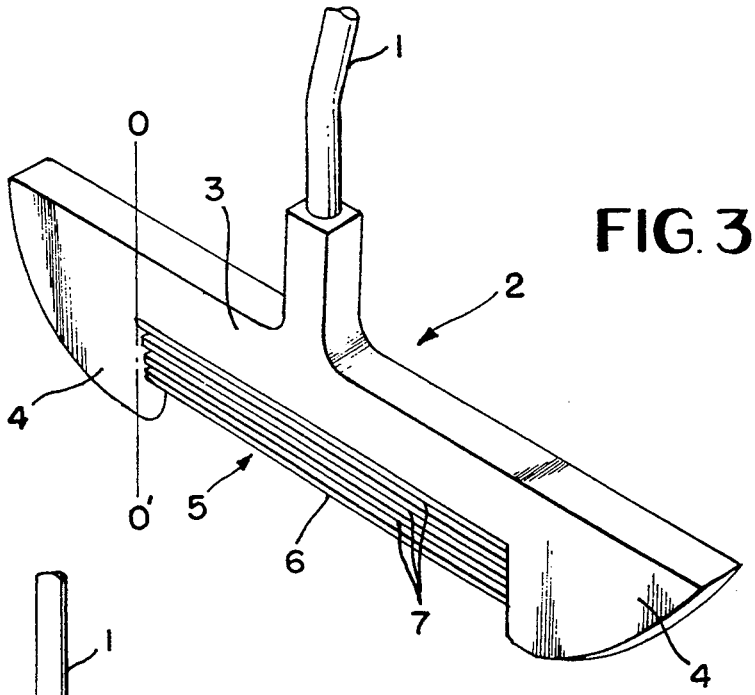
FIG. 3 is a perspective view of a putter head of the present invention.

Referring to the drawings, FIG. 3 is a perspective view of the putter of the present invention. A generally inverse U-shaped head 2 is fixed to the lower end of a handle 1. The inverse U-shaped head 2 has a recess 5 at the lower, middle end thereof and a front, central, hitting portion 3 for striking a golf ball 8. The rear face of the front hitting portion 3 has a recess 11 for decreasing the weight of the head 2.

At either side of the hitting portion 3 is provided a downwardly extending weight portion 4 for balancing the head 2.

The extending distance of the weight balancing portion 4 from the bottom face 6 of the hitting portion 3 or the depth of the recess 5 is shorter than the radius of the golf ball 8. The extended length of the weight balancing portion 4 is approximately two thirds the radius of the ball.

Figure 4A:
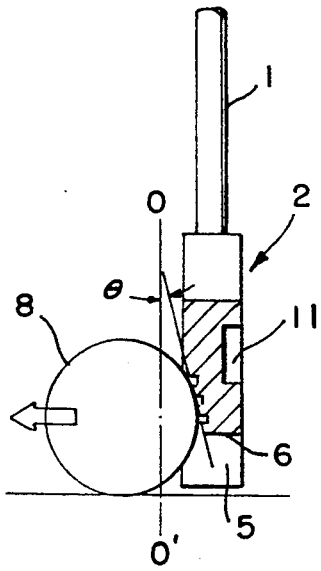
FIGS. 4A, 4B and 4C show the swing with the head of the putter of the present invention.
Figure 4B:
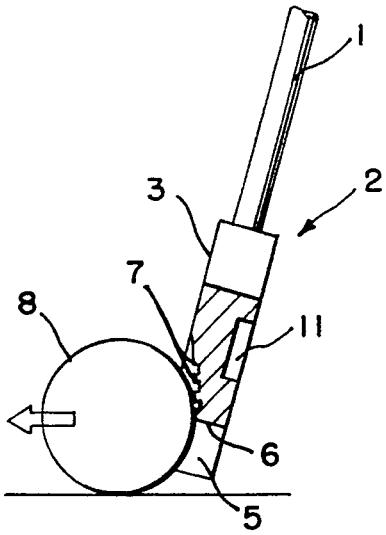
Figure 4C:
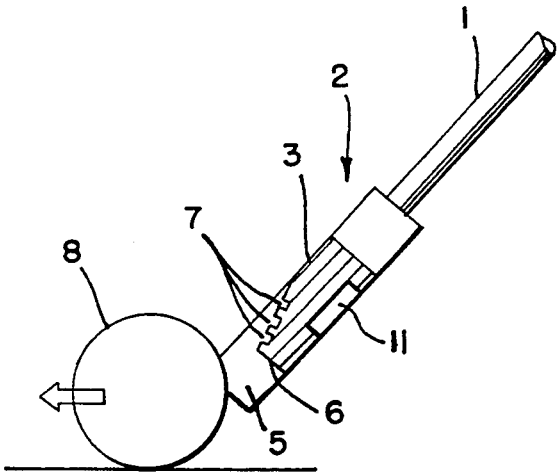

The hitting portion 3 is declined downwardly and rearwardly with respect to the vertical axis 0—0 and has a plurality of lateral grooves 7. FIGS. 4A, B, and C are sectional views showing the condition in which the putter head 2 contacts with the ball 8 when the head 2 swings. FIG. 4A shows a condition immediately before the golf ball is struck, wherein a portion a little above the center of the ball 8 contacts a portion adjacent to the top groove or second from the top groove.

In the condition, the handle is perpendicular to the surface of the putting green, and the lower end of the weight balancing portion 4 grazes the putting green and is in a slightly raised position from the surface of the putting green. As the swing proceeds, the ball moves toward the hole, and the contact point of the ball with the hitting portion 5 moves downwardly of the hitting portion 5.

The lateral grooves 7 serve to increase the force of rotation of the ball by contacting with the prominence and depression face of the ball 8. As the swing further proceeds, the hitting portion 3 is separated from the ball 8.

The above-described features of the present invention are important differences over the prior art putters. As shown in FIG. 2, with the prior art putter, the contact time between the ball and the putter head is lengthened, resulting in trembling of the putter head subsequent to swinging. However, the hitting portion of the putter of the present invention is separated from the ball immediately after applying force to the ball in a short time when striking the ball 8. With this construction, the change of the course of the golf ball caused by the unstable swing posture, is prevented.

It is noted that the putter is used to put the golf ball into the hole from a short distance (maximum 20 yards) without requiring strong force.

Therefore, correctness is the life and soul of the putter. Accordingly, the putter should apply a strong rotation force to the ball, even when striking the ball with a little force. For this purpose, the front hitting portion of the head is inclined rearwardly and downwardly with respect to the vertical axis 0—0.

With this arangement, the contact point between the hitting portion and the ball when swinging, is not lower than the center of the ball, and the floating of the ball is prevented. In addition, the contact point is provided at the upper portion of the center of the ball, which gives the same effect as when hitting the upper side of a billard ball. That is, the golf-ball has a strong force to continue to rotate. It is desirable that the inclined angle of the hitting portion is 3 to 15 degrees.

As described above, with the putter of the present invention, the time when the ball and the hitting portion contact, when striking the ball is shortened. Therefore, the decrease of the correctness caused by the trembling of the posture of a golfer when swinging, is prevented. Furthermore, a strong force of rotation is applied to the golf ball, thus improving the force to continue rotation thereof.

What is claimed is:

1. A head for use with a golf club which is used as a putter comprising:

a front hitting portion;

a rear, weight decreasing recess;

side portions positioned on opposing ends of said front hitting portion; and a weight balancing portion extending downwardly from each side of the front hitting portion, wherein a downwardly extending distance of said weight balancing portion from a bottom face of said hitting portion to a lower end of said weight balancing portion is approximately two-thirds the radius of the golf ball so that the head may have a recess at a lower end thereof, thus assuming an inverse U-shape.

2. The putter head according to claim 1, wherein the hitting portion of the putter head is inclined rearwardly and downwardly with respect to a longitudinal axis of the golf club.

3. The putter head according to claim 2, wherein said inclination angle of the hitting portion is 3 to 15 degrees.

4. The putter head according to claim 1, wherein said hitting portion of the putter head has a plurality of lateral grooves.

* * * * *

UNITED STATES PATENT AND TRADEMARK OFFICE

CERTIFICATE OF CORRECTION

PATENT NO. : 5,348,301

DATED : September 20, 1994

INVENTOR(S) : Jong-Nam MA

It is certified that error appears in the above-indentified patent and that said Letters Patent is hereby corrected as shown below:

On the Title Page, insert the Heading,

-- [30] Foreign Application Priority Data,

June 11, 1992 [KR] Korea ..... 92-10345 --

Signed and Sealed this

Twenty-eight Day of March, 1995

*Attest:*

Bruce Lehman

BRUCE LEHMAN

*Attesting Officer*

*Commissioner of Patents and Trademarks*